United States Patent [19]

Collins

[11] Patent Number: 5,054,784

[45] Date of Patent: Oct. 8, 1991

[54] GOLF CLUB HEAD

[76] Inventor: Frank T. Collins, HC01 Pilot Knob Rd., Kattskill Bay, N.Y. 12844

[21] Appl. No.: 586,886

[22] Filed: Sep. 24, 1990

[51] Int. Cl.[5] ..... A63B 53/04

[52] U.S. Cl. ..... 273/167 E; 273/167 H; 273/169

[58] Field of Search ..... 273/167-175, 273/77 R, 193 R, 194 R; D21/214, 215, 216

[56] References Cited

U.S. PATENT DOCUMENTS

| | | | |
|---|---|---|---|
| 780,776 | 1/1905 | Brown | 273/167 E |
| 3,468,544 | 9/1969 | Antonious | 273/167 E |
| 3,794,328 | 2/1974 | Gordon | 273/167 E |
| 4,065,133 | 12/1977 | Gordos | 273/167 E |
| 4,809,982 | 3/1989 | Kobayashi | 273/167 E |
| 4,869,508 | 9/1989 | Miller | 273/167 E X |

FOREIGN PATENT DOCUMENTS

| | | | |
|---|---|---|---|
| 642134 | 6/1962 | Canada | 273/167 E |

*Primary Examiner*—Edward M. Coven
*Assistant Examiner*—Sebastiano Passaniti
*Attorney, Agent, or Firm*—Heslin & Rothenberg

[57] ABSTRACT

A wood-type golf club head exhibiting improved aerodynamic performance enabling the golfer to generate greater club head speed during a swing includes a conventionally shaped wood-type club head. The grooves at the club head form openings which lead into passages which are in air flow relationship to vents located at the back of the club head. During a swing, air is allowed to flow through the club head by entering the grooves and flowing through one or more passages out of the vents at the back of the club head.

3 Claims, 2 Drawing Sheets

GOLF CLUB HEAD

BACKGROUND OF THE INVENTION

The present invention relates to a golf club head and, more particularly to an improved wood-type golf club head capable of generating greater club head speed during a swing due to increased aerodynamic performance and decreased drag.

A critical factor in improving the distance of a golf shot is to increase the club head speed during a golf swing and to increase the kinetic energy transferred to the ball when contact is made. In a conventional wood-type golf club head, the head contains a substantially flat face with horizontal grooves on the surface which makes contact with the ball during a shot. As the club is swung, air creates drag on the club head because of its relatively high drag coefficient. During the swing, air travels into the face and over the top and bottom of the club head. At the top and bottom of the head the air forms a boundary layer which produces a drag force. As the air flows over the top and bottom of the club head a wake or area of low pressure is created at the back of the club head. During the golf swing, a high pressure area at the face of the club head and the low pressure area at the back of the club head contribute to the drag force thereby impeding optimum club head speed.

Certain references disclose placing passages through the golf club head to allow air to flow through the club head via the passages toward the back of the club head thereby alleviating the low pressure wake. U.S. Pat. No. 3,794,328 to Gordon discloses a wood-type golf club head having two substantially horizontal passages formed through the golf club head extending from the face to the back of the club head. The passages are located at the toe and heel of the golf club head so as to not interfere with the striking surface at the club head's face. U.S. Pat. No. 4,809,982 to Kobayashi discloses a golf club head having one or more passages therein which extend from the back of the club head either diagonally to the top of the club head or, alternatively, diagonally to the bottom of the club head. The passage is designed to allow air from the boundary layer at the top or bottom of the club head to enter the passage and flow towards the back of the club head thereby increasing the pressure at the rear of the club head and decreasing the drag.

Although these references help to decrease the drag of a golf club head during a swing, there is still a considerable amount of drag created by the face of the golf club head at the striking surface. Moreover, since a considerable low pressure area still exists at the back of the club head during a swing, a relatively high pressure gradient exists between the face and back of the club head.

It is therefore an object of the present invention to provide a wood-type golf club head which is capable of decreasing the drag of the club head thereby increasing club head speed during the golf swing to increase the distance of a golf shot.

It is also an object of the present invention to provide an improved wood-type golf club head which is capable of allowing air to pass therethrough without impeding the grooves located at the face of the golf club head and without sacrificing control over the golf shot.

SUMMARY OF THE INVENTION

In accordance with the present invention, the wood-type golf club head includes a face for hitting a golf ball, a back at the opposite side of the face, an outer surface extending from the face to the back side, grooves within the face forming entrances to one or more passages within the golf club head, and vents in the back of the golf club head in air flow relationship with the passages. As the golf club with the club head of the present invention is swung, air enters the grooves at the face of the head and flows through the passages within the club head and through the vents in the back of the club head.

The golf club head may also contain a hollow body forming a cavity in air flow relationship with one or more passages and one or more vents at the back of the head. Also, the cross sectional area of the vents at the back of the head may be at least equal to the cross sectional area of the grooves forming the entrances of the passages at the face of the head.

The improved wood-type golf club head in accordance with the present invention contains several advantageous features. The head is capable of allowing a substantial amount of air to flow therethrough thereby decreasing the pressure at the club head face and increasing the pressure at the back of the club head so as to minimize drag and resistance during the golf swing. This will effectively increase club head speed and the distance of a golf shot. Moreover, the improved golf club head leaves the club face, including the grooves thereon, intact and unobstructed to allow the golfer to have control over his shots. Accordingly, the golfer may still alter the spin of the ball and play different types of shots.

BRIEF DESCRIPTION OF THE DRAWINGS

The aforementioned objects, features and advantages of the invention are indicated in the drawings in which.

DESCRIPTION OF THE PREFERRED EMBODIMENT

Figure 1:
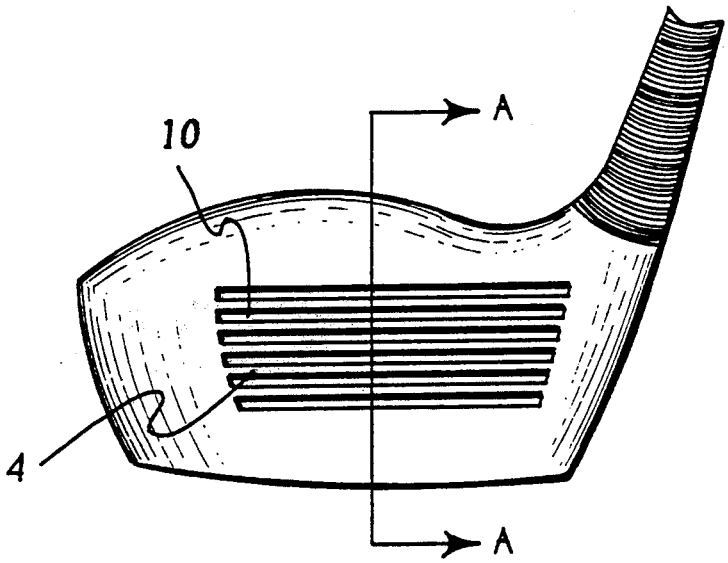
FIG. 1 is a front view of the wood-type golf club head in accordance with the present invention.
Figure 2:
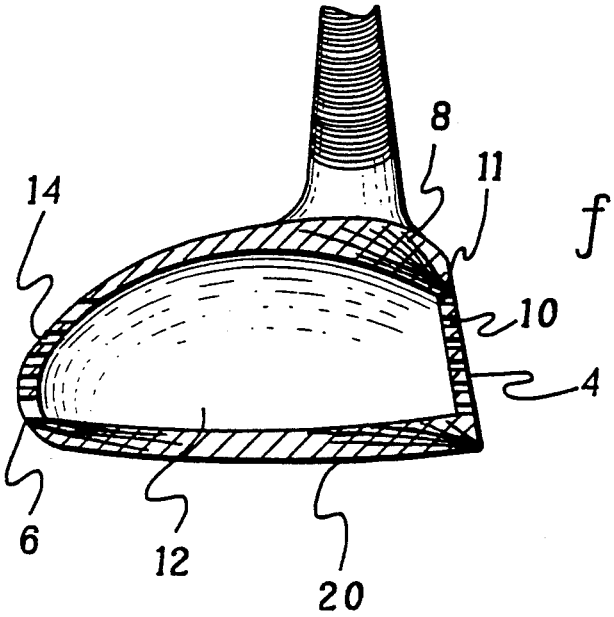
FIG. 2 is a sectional view of one embodiment of the golf club head in accordance with the present invention along line AA in FIG. 1.
Figure 3:
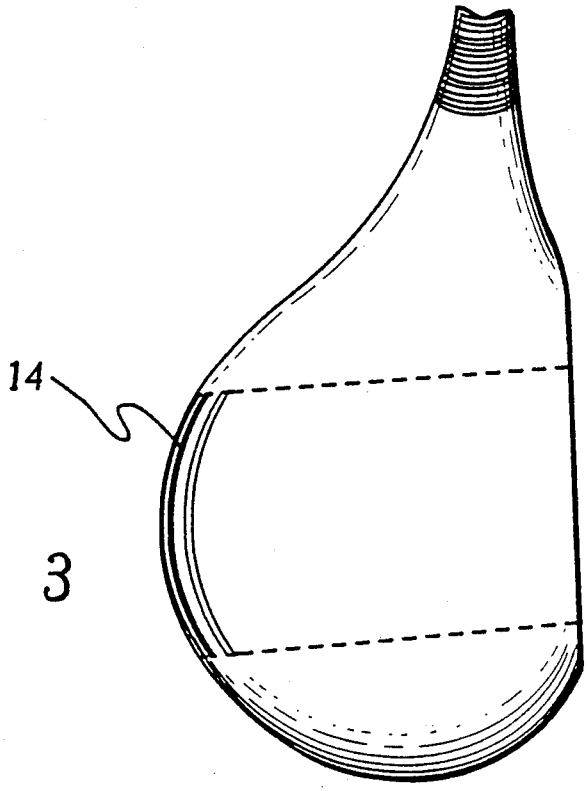
FIG. 3 is a top view of the wood-type golf club head in accordance with the present invention.

FIGS. 1 and 2 indicate an embodiment of the present invention as incorporated in a wood-type golf club head. The golf club head 2 comprises a face 4, a back 6, an outer top surface 8, and an outer bottom surface 20 which define the shape and outer configuration of a wood-type golf club head. The face contains a plurality of horizontally extending grooves 10 which run from the toe to the heel of the club head. The grooves form entrances to passages 11 which lead to a cavity 12 located within the center of the golf club head which is substantially hollow. The back of the golf club head contains vents 14 which are in air flow relationship with the cavity 12. When the golf club head is swung, air passes through the grooves 10 into the cavity 12 and out the vents 14. These features facilitate improved club head speed, during a swing, compared to conventional and other improved golf club heads. These features also increase the kinetic energy in the club head, during a swing, which is transferred to the ball during the golf shot, resulting in improved distances on each shot.

When the club head is swung, a substantial amount of air is allowed to flow directly through the golf club head, via the grooves 10, thereby decreasing the pressure at the face of the club head, increasing the pressure at the back of the club head, and reducing drag. To achieve maximum club head speed, it is desirable to construct the club head so that the cumulative cross sectional area of the vents 14 is at least equal to the cumulative cross sectional area of the grooves 10 which form entrances to the cavity 12. This enables the pressure gradient within the cavity 12 to remain at a minimum so as to optimize drag reduction.

As shown in FIG. 1, the club head in accordance with the present invention may have a face 4 which appears substantially identical to the face of a conventional wood-type club head. However, the grooves 10 are actually entrances or passages which lead to the cavity 12. Accordingly, the grooves function to allow air to pass into the club head while also creating a spin on the golf ball during contact. This configuration improves club head speed without impairing the striking surface at the face of the club head.

The club head should preferably be made out of metal alloys which are typically used to manufacture conventional metal woods. The golf club head can therefore be cast molded for ease of manufacture.

Figure 4:
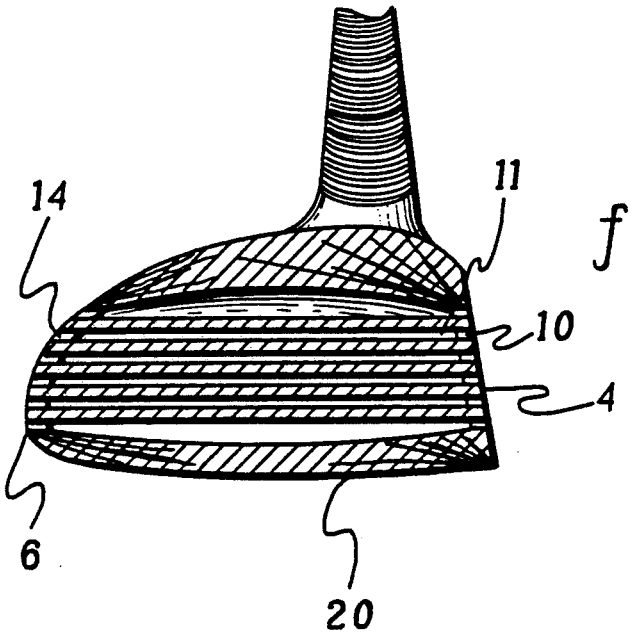
FIG. 4 is a sectional view of the golf club head taken along line AA of FIG. 1 in accordance with a second embodiment of the present invention.

In another embodiment of the invention as shown in FIG. 4, the grooves 10 form entrances to passages 16 which are in air flow relationship with separate vents 14 at the back of the club head. The club head does not contain a cavity and is not completely hollow thereby increasing the weight and mass of the club head. This configuration may be suitable for golfers who prefer a heavier club. Preferrably, the cross sectional area of each individual passage 16 should not be less than the cross sectional area of the corresponding groove 10 forming the entrance to the passage. This will optimize drag reduction and decrease the pressure gradient from the face to the back of the club head. This embodiment of the club head in accordance with the present invention may be manufactured from solid wood or laminates as well as cast metal alloys.

Figure 5:
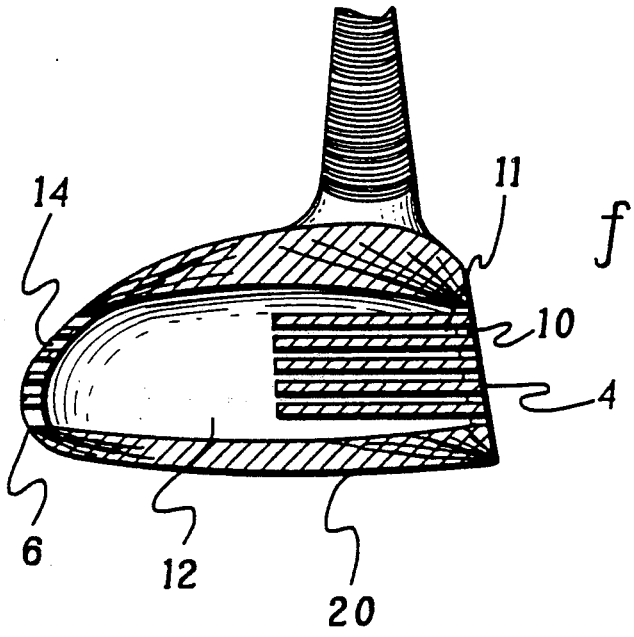
FIG. 5 is a sectional view of the golf club head taken along line AA of FIG. 1 in accordance with yet another embodiment of the present invention.

It is also possible to construct a golf club head, in accordance with the present invention, having a relatively small volume within the cavity 12, as shown in FIG. 5. The volume of the cavity may be altered by increasing or decreasing the depth of the vents and the depth of the passages formed by the grooves 10. By varying the volume of the cavity 12, the weight and feel of the club may be altered and/or customized to a particular golfer's taste. Notwithstanding the volume of cavity 12, however, each embodiment of the present invention may incorporate a club face as shown in FIG. 1.

There has therefore been described a new and improved golf club head which permits the passage of air from the face to the back of the club head while the club is swung. The wood-type club head increases the speed of the golf swing by reducing the air friction and drag to produce longer shots without loss of control.

Although the invention has been disclosed in the embodiments depicted herein, it is apparent that various modifications may be made without departing from the spirit of the invention. Any such modifications are intended to be within the scope of the invention as defined by the following claims.

What is claimed is:

1. A golf club head for a golf club comprising:

a face forming a surface for hitting a golf ball;

a back at the opposite side of the face;

an outer top surface extending from the face to the back;

an outer bottom surface extending from the face to the back wherein said face, back, outer top surface and outer bottom surface form a wood-type golf club head;

a plurality of vertically spaced entrances leading to one or more passages within the golf club head formed within and extending in a direction substantially horizontally across substantially the entire face, said passages extending through the club head in a direction substantially normal to the face towards the back of the club head; and one or more vents in the back of the golf club head in air flow relationship with one or more of the passages, thereby allowing air to enter the entrances and flow through the passages and vents therein as the club is swung.

2. A golf club head for a golf club comprising:

a face forming a surface for hitting a golf ball;

a back at the opposite side of the face;

an outer top surface extending from the face to the back;

an outer bottom surface extending from the face to the back wherein said face, back, outer top surface and outer bottom surface form a wood-type golf club head;

a plurality of vertically spaced entrances leading to one or more passages within the golf club head formed within and extending in a direction substantially horizontally across substantially the entire face, said passages extending in a direction substantially normal to the face towards the back of the club head;

a cavity within the club head, said cavity being in air flow relationship with one or more of the passages; and one or more vents in the back of the golf club head, the one or more vents being in air flow relationship with one or more of the passages wherein as the club is swung air flows through the passages, cavity, and vents.

3. The golf club head according to claim 1 or 2 wherein the cross sectional area of the vents at the back of the head are at least equal to the cross sectional area of the entrances of the passages at the face of the head.

* * * * *